US007022224B2

(12) United States Patent
Stafeev

(10) Patent No.: US 7,022,224 B2
(45) Date of Patent: Apr. 4, 2006

(54) MAGNETIC HYDROSEPARATOR

(76) Inventor: Aleksei Alekseevich Stafeev, Ul Vozrozhdenya, 27, Republic of Karelia (RU) 186931

( * ) Notice: Subject to any disclaimer, the term of this patent is extended or adjusted under 35 U.S.C. 154(b) by 0 days.

(21) Appl. No.: 10/492,767

(22) PCT Filed: Oct. 17, 2002

(86) PCT No.: PCT/IB02/04271

§ 371 (c)(1),
(2), (4) Date: Sep. 3, 2004

(87) PCT Pub. No.: WO03/033160

PCT Pub. Date: Apr. 24, 2003

(65) Prior Publication Data

US 2005/0011813 A1 Jan. 20, 2005

(30) Foreign Application Priority Data

Oct. 18, 2001 (RU) ..... 2001128140

(51) Int. Cl.
*B03B 7/00* (2006.01)
*B03C 1/30* (2006.01)
*B03D 1/24* (2006.01)

(52) U.S. Cl. ..... 210/170; 209/39; 209/158; 209/159; 209/223.1; 209/224; 209/225; 209/232

(58) Field of Classification Search ..... 209/39, 209/158, 159, 170, 223.1, 223.2, 224, 225, 209/232
See application file for complete search history.

(56) References Cited

U.S. PATENT DOCUMENTS 555,920 A * 3/1896 Boericke
954,015 A * 4/1910 Bent
1,392,413 A * 10/1921 Gow
2,522,556 A * 9/1950 Wuensch
2,560,809 A * 7/1951 Martin
2,564,515 A * 8/1951 Vogel
2,717,080 A * 9/1955 Anderson
2,783,884 A * 3/1957 Schaub
2,874,839 A 2/1959 Rogers
3,246,749 A * 4/1966 Moser
4,102,780 A 7/1978 Sun et al.
4,921,597 A 5/1990 Lurie
5,192,423 A 3/1993 Duczmal et al.
5,377,845 A * 1/1995 Hamen et al. ..... 209/223.2
5,568,869 A 10/1996 Turkenich et al.
5,896,997 A 4/1999 Tanner
5,961,055 A 10/1999 Lehtinen
6,026,965 A 2/2000 Berardi et al.

FOREIGN PATENT DOCUMENTS

RU 2001684 10/1993
SU 1440544 * 11/1988
SU 1488004 * 6/1989
SU 1669559 8/1991

* cited by examiner

*Primary Examiner*—Thomas M. Lithgow
(74) *Attorney, Agent, or Firm*—Huntley & Associates, LLC; Donald W. Huntley

(57) ABSTRACT

The invention relates to the concentration of useful minerals and may be used in the concentration of iron ores. The magnetic hydroseparator includes a body with an upper drain, a supply device, a driving scraping device, set up with the possibility of interacting with the inner surface of an annular magnetic system and made with a changing number of revolutions, the annular magnetic system being set up within the upper part of the body, an unloading device with a washing device made with the possibility of regulating the supply of the washing liquid, gas or mixture of these, the lower part of the body being made in the shape of a cone. The claimed invention permits increasing the efficiency of concentration. One dependent claim, two illustrations.

1 Claim, 2 Drawing Sheets

MAGNETIC HYDROSEPARATOR

BACKGROUND OF THE INVENTION

The invention relates to the concentration of useful minerals and may be used in the concentration of iron ores.

DESCRIPTION OF RELATED ART

A magnetic hydroseparator is known (Inventor's Certificate 1488004 A1, 23.06.89, B 03 C 1/10) that includes a body with an upper drain, a supply device, a driving scraping device for interaction with an annular magnetic system, and an unloading device with a washing device.

It is known that in deslimers (hydroseparators) a segregation of the material into layers occurs under the action of the forces of gravitation. There is more silica and its attachments to iron in the upper layers than in the lower layers. For this reason, the maximum quantity of attachments rich in silica (quartz) is present in the drain at the level of the drained rock. In a prototype, the annular magnetic system is fastened inside, in the upper part of the body, at the level of the drained rock. Such positioning of the annular magnetic system makes the work of the deslimer inefficient, since it puts back into the process most of the quartz (waste rock) that must be removed in the tailings. The second rotating part of the magnetic system, together with the sprinkling system and the fixed motionless scrapers, works in a relatively dense iron-magnetic suspension and therefore, because of the complicated construction, has a great propensity to block up and jam. The inefficiency of operation of the unloading device of the prototype may be ascribed to the defects listed above.

It is known that the magnetic product in the unloading of deslimers has high density, therefore its passage through a large quantity of pipes and horizontal collectors will be extremely difficult.

SUMMARY OF THE INVENTION

The present invention provides a magnetic hydroseparator that exhibits increased efficiency of concentration.

Specifically, the present invention provides, in a magnetic hydroseparator for separating iron ore from a slurry of iron ore and rock in at least one fluid, the hydroseparator comprising a body with an upper drain, a supply device operatively connected to the body, a driving scraping device in the upper part of the body, the driving scraping device operatively positioned for interaction with an annular magnetic system, and an unloading device at the bottom of the body with a washing device, the improvements wherein the hydroseparator is vertically oriented, the annular magnetic system extends below the level of the upper drain, the driving scraping device is adapted to vary its speed of revolution, the mechanism is adapted to vary the quantity of fluid used in the device and the concentration of gas in the fluid, and wherein the lower part of the body is conically shaped.

Figure 1:
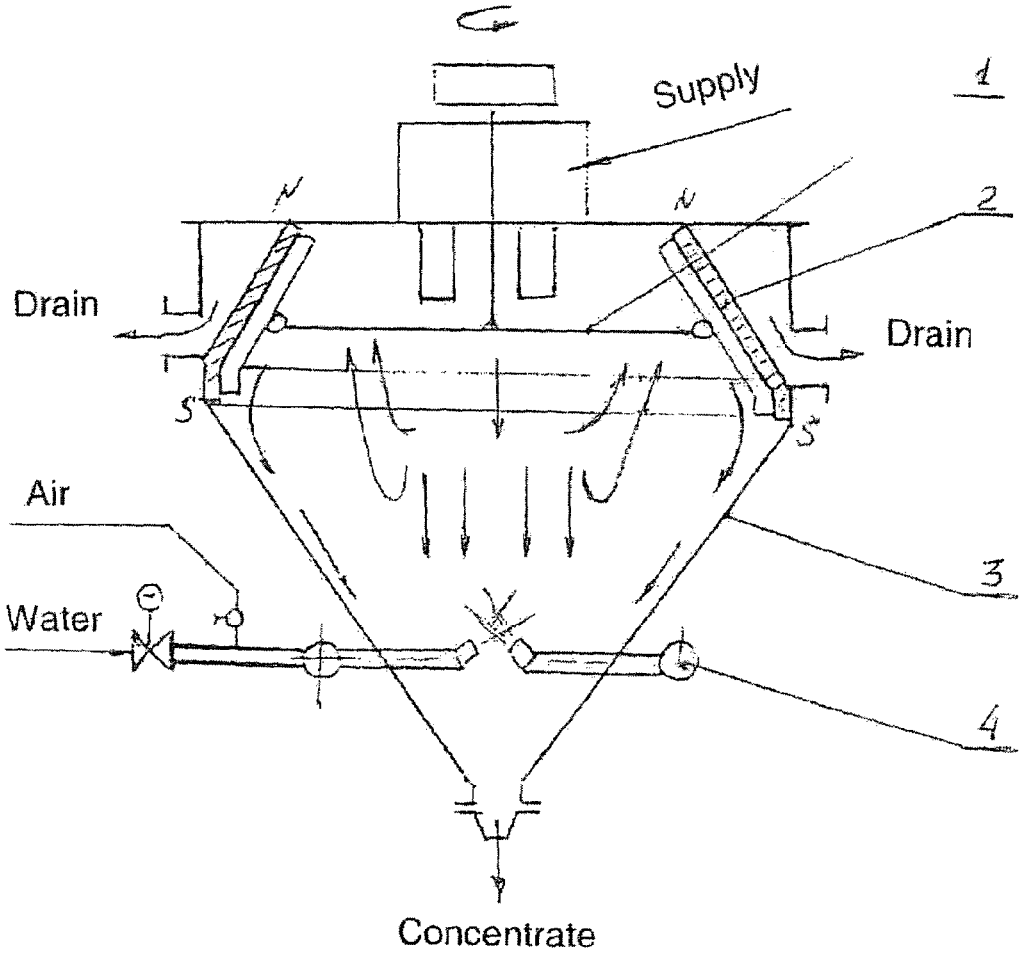
FIG. 1 shows a diagrammatic illustration of the magnetic hydroseparator.

The magnetic hydroseparator consists of a driving scraping device with a changing number of revolutions 1, an annular magnetic system 2 set up below the level of the drained rock, within the body 3 in its upper part, a washing device 4 with the possibility of regulating the supply of the washing liquid, gas or mixture of these, and an unloading device in the shape of a cone 5.

Figure 2:
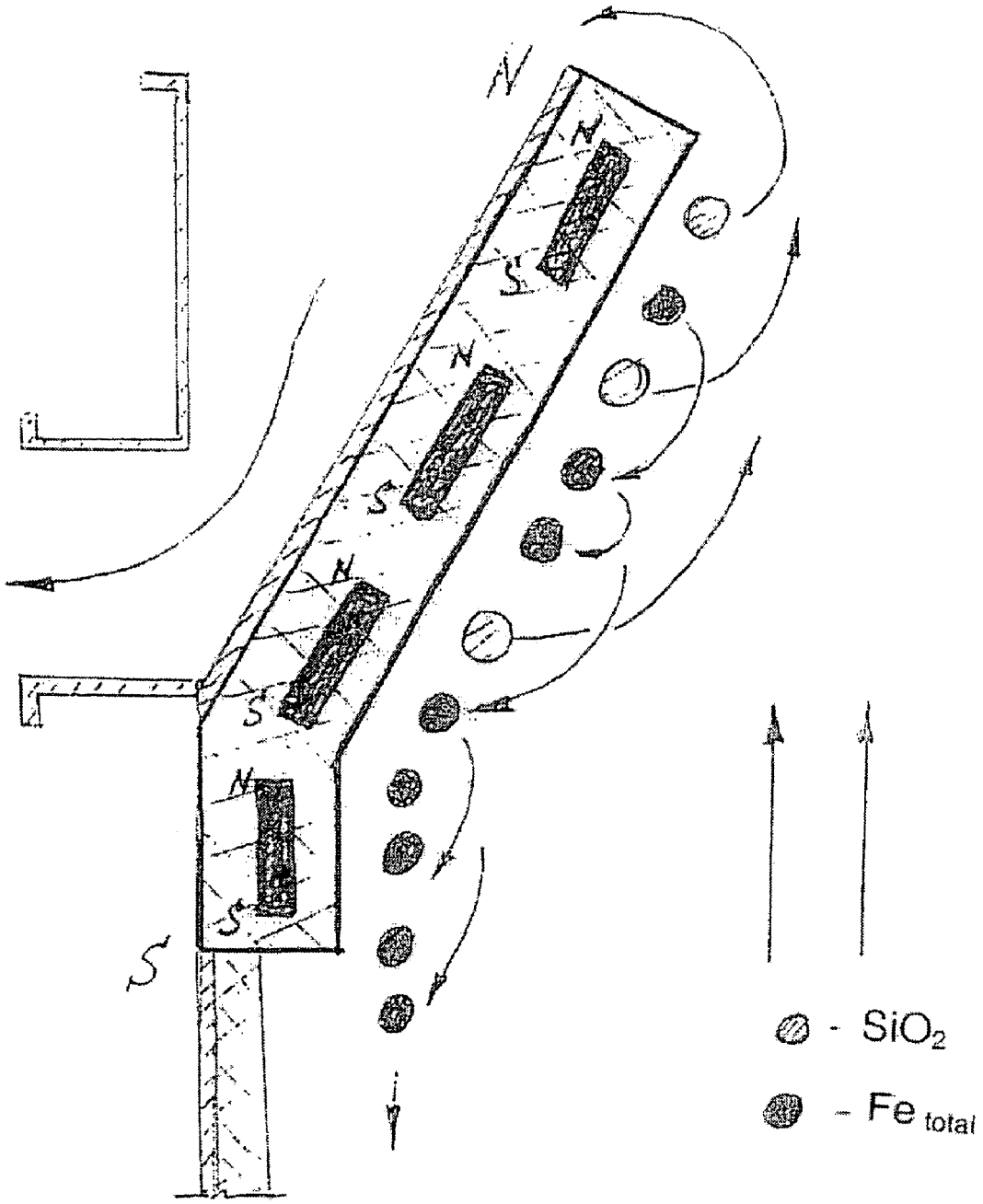
FIG. 2 shows a diagrammatic illustration of an upper portion of the magnetic hydroseparator.

The magnetic hydroseparator works as follows. The supply, in the form of concentrated pulp, enters from above, where, under the action of gravitational forces, the sedimentation of its granules occurs. The concentrated pulp is a ferriferous suspension consisting of grains of various sizes, mainly of magnetite, silica and its rich and poor attachments. In the area of activity of the washing device 4, made with the possibility of regulating the supply of the washing liquid, gas or mixture of these, grains of silica and attachments poor in magnetite are separated from the ferriferous suspension and are lifted by the rising stream of washing liquid, water, for example, into the area of the drain. Fine particles of magnetite will also inescapably enter the area of the drain with the rising stream. They, as well as attachments rich in iron, are caught by the annular magnetic system 2 set up within the upper part of the body 3 below the level of the drained rock, are classified, separated, flocculated and, with the aid of the driving scraping device with a changing number of revolutions 1, are lowered into the unloading area. In this process, waste rock (silica) departs into the drain. The free grains of silica, bypassing the magnetic field, are removed with the drain. The sludge particles situated among the grains of magnetite in a jammed state, as well as fine particles of magnetite and various attachments, make up a material from which sedimentation is formed on the controlling magnetic system. Under the action of the scraping device, this conglomerate is periodically torn off the surface of the magnetic system, in which process, the particles of magnetite with rich attachments are lowered in level, under the effect of gravitational forces and magnetic forces, while the poor attachments, together with the particles of sludge, are carried into the drain with the rising current (FIG. 2). After each pass of the scraper there occurs a shaking and renewed cleaning of the sediment. The grains of the useful component, having moved downward, flocculate, accumulate under the magnetic system and, under the effect of gravitational forces, are lowered towards the unloading area, where, together with the useful component deposited owing to gravitational forces, they are removed through the unloading device made in the shape of a cone 5.

In the magnetic hydroseparator, as a function of the given size, the rising stream carries the grains of minerals of various sizes into the area of activity of the annular magnetic system. In this process, the large grains of silica depart into the drain while the large grains of magnetite are held back by the magnetic system and return into the technology. In this way, the magnetic hydroseparator partially carries out a classifying function. Any classifier may, for example, send the large grains of mineral, consisting in practical terms of silica, into the mill equally with the large grains of magnetite. This circumstance is the main defect of modem concentration arrangements. By its magnetic properties, the magnetic hydroseparator produces a classification not only of grains of pure magnetite or quartz, but also of their rich and poor attachments. The quality of the division depends on the operating characteristics of the annular magnetic system, the washing device and the scraping device.

The magnetic hydroseparator can also carry out the functions of a magnetic separator, only it carries out these functions far more efficiently and economically. In magnetic separators, the concentration process is carried out by means of the extraction of magnetic iron out of concentrated pulp, the quantity of iron in which is increased by the end of the process. In magnetic hydroseparators, the concentration process is carried out by means of the extraction of silica out of concentrated pulp, the quantity of silica in which correspondingly decreases by the end of the concentration process. After the second stage of wet magnetic separation, for example, the total iron content ($Fe_{total}$) in the concentrate amounts to 50–53% and silica ($SiO_2$) makes up 22–19%, but after the third stage of wet magnetic separation, $Fe_{total}$=63–65% and $SiO_2$=9–7%. Therefore, the apparatus works more efficiently than magnetic separators. It carries out the concentration process by extracting the lesser from the greater.

The processes of classification, separation and sludge removal in magnetic hydroseparators proceed simultaneously and depend on the forces of gravitation, the, intensity of the rising stream, the magnetic field of the annular magnetic system and the speed of rotation of the scraping device. The technological parameters of the apparatus depend on the stage of concentration and all, apart from the forces of gravitation, can be changed and regulated.

The intensity of the rising stream is regulated by the quantity of water supplied through the washing device, using an electrically operated slide-valve, for example. The intensity and degree of success of the rising stream is increased by supplying compressed air to the washing device. The quantity of air supplied is regulated by an electrically operated valve.

The thickness of the sedimentation on the annular magnetic system is regulated by changing the speed of rotation of the scraping device. At low speeds of rotation of the scraping device, the formation of sediment will occur more rapidly and it will enclose within itself the lines of magnetic force, the effect of which is to change the ability of the magnetic system to extract rich or poor attachments from the drain. The frequency of rotation of the scraping device is regulated by the frequency of rotation of its electric motor.

Increasing or decreasing the intensity of the rising stream makes it possible to carry on the concentration process with parameters set for the iron content in the concentrate and its specific surface. This same result may be obtained, though to a lesser degree, by changing the number of rotations of the scraping device.

All of the foregoing makes it possible to automate concentration processes by measuring in the stream the iron or silica content in the concentrate and in the drain, and subsequently sending a control signal to the electrical drives of the scraping and washing devices.

It can also be added to the merits of the apparatus that with its help concentration processes are carried out with the effective removal of silica of various grain sizes while losses of magnetic iron are low. With the help of the apparatuses, it is possible to obtain a concentrate having any specific surface without a risk of the over-crushing of quartz. This is very important for the efficiency of performance of concentration processes.

The use of magnetic hydroseparators in modem concentration works permits a qualitative change in their concentration technology. Because of the increase in the quality of the concentrate and the reduction in the expenditure of energy, it is possible to obtain an economic effect worth tens of millions of US dollars.

On the basis of the foregoing, the conclusion can be drawn that the proposed invention is useful, new, possesses inventive level, increases the efficiency of concentration and can be used in the, concentration of iron ores.

What is claimed is:

1. In a magnetic hydroseparator for separating iron ore from a slurry of iron ore and rock in at least one fluid, the hydroseparator comprising a body with an upper drain, a supply device operatively connected to the body, a driving scraping device in the upper part of the body, the driving scraping device operatively positioned for interaction with an annular magnetic system, and an unloading device at the bottom of the body with a washing device, the washing device includes means for adding a washing fluid which is a combination of liquid and gas to the body, the improvements wherein the hydroseparator is vertically oriented, the annular magnetic system extends below the level of the upper drain, variable speed means for rotatably driving the, scraping device is to vary its speed of rotation, the washing device includes means to vary the quantity of the washing fluid used in the device and the concentration of gas in the washing fluid, and wherein the lower part of the body is conically shaped.

* * * * *